US005797683A

United States Patent [19]

Gunzi et al.

[11] Patent Number: 5,797,683

[45] Date of Patent: Aug. 25, 1998

[54] SEALABLE BAG

[75] Inventors: Laurence A. Gunzi; Massimo G. F. Malavasi, both of London, England

[73] Assignee: Aquaman (UK) Ltd., London, England

[21] Appl. No.: 690,064

[22] Filed: Jul. 31, 1996

[30] Foreign Application Priority Data

Sep. 4, 1995 [GB] United Kingdom ..... 9517991

[51] Int. Cl.[6] ..... B65D 33/17

[52] U.S. Cl. ..... 383/68; 383/79; 383/92

[58] Field of Search ..... 383/63, 68, 69, 383/71, 79, 86.1, 86.2, 92; 150/123; 220/323, 325, 327

[56] References Cited

U.S. PATENT DOCUMENTS

| | | | |
|---|---|---|---|
| 1,038,351 | 9/1912 | Graham | 383/68 X |
| 1,540,005 | 6/1925 | Hiering | 150/123 X |
| 1,566,867 | 12/1925 | Hetzer et al. | 383/68 X |
| 1,931,707 | 10/1933 | Quigan | 150/123 X |
| 2,304,528 | 12/1942 | Bafia | 150/123 X |
| 2,599,738 | 6/1952 | Ames | 383/68 X |
| 2,616,470 | 11/1952 | Rifkin | 383/68 X |
| 2,678,671 | 5/1954 | Rifkin | 383/68 |
| 4,175,604 | 11/1979 | Bonner . | |

FOREIGN PATENT DOCUMENTS

| | | |
|---|---|---|
| 221458 | 9/1924 | United Kingdom . |
| 2161138 | 1/1986 | United Kingdom . |
| 2179323 | 3/1987 | United Kingdom . |

*Primary Examiner*—Jes F. Pascua

*Attorney, Agent, or Firm*—Wallenstein & Wagner, Ltd.

[57] ABSTRACT

A bag (2) with an access opening defined by a pair of edges and a closure (4) for closing the access opening is described. The closure (4) comprises a first bar (6, 8, 6*a*, 8*a*) secured to one edge and a second bar (6, 8, 6*a*, 8*a*) releasably connectable to the first with the edges clamped together to close the opening. The releasable connection is formed by at least one bayonet connector (20, 22, 30, 20*a*, 22*a*, 33*a*).

7 Claims, 6 Drawing Sheets

FIG. 12
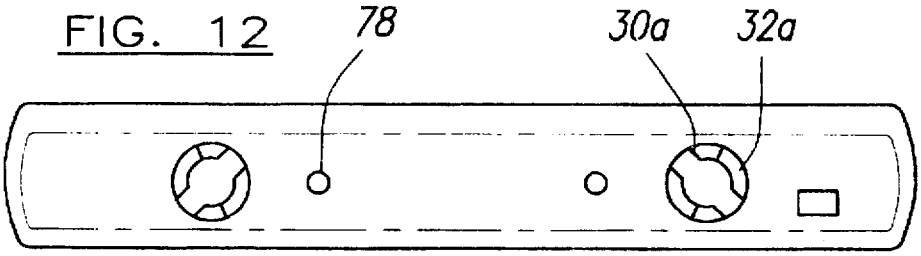
FIG. 10
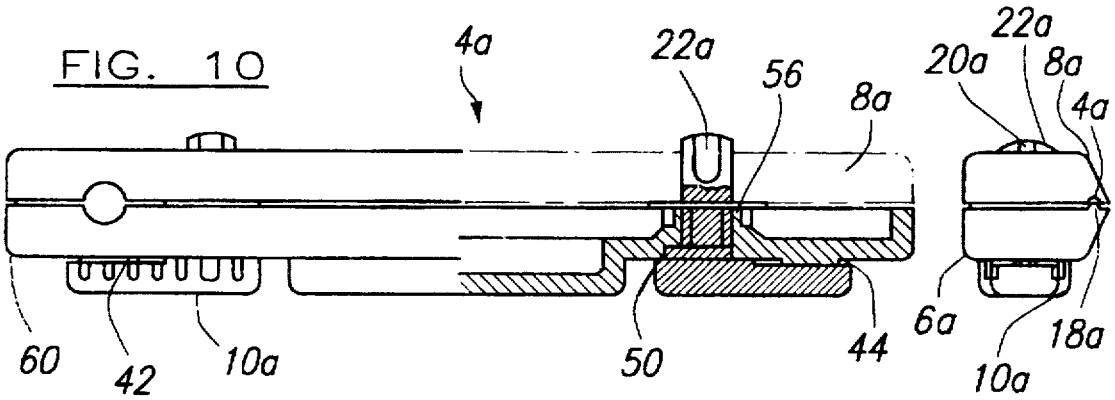
FIG. 11
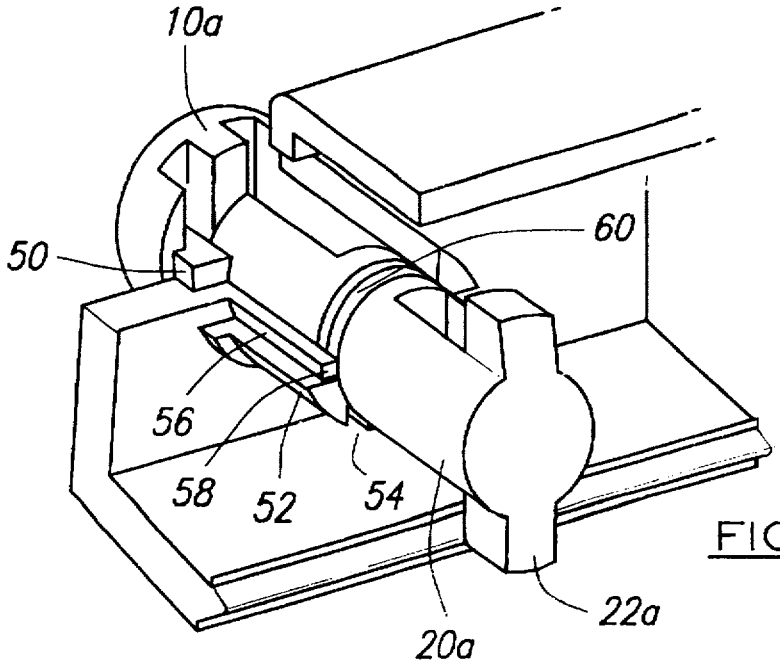
FIG. 13

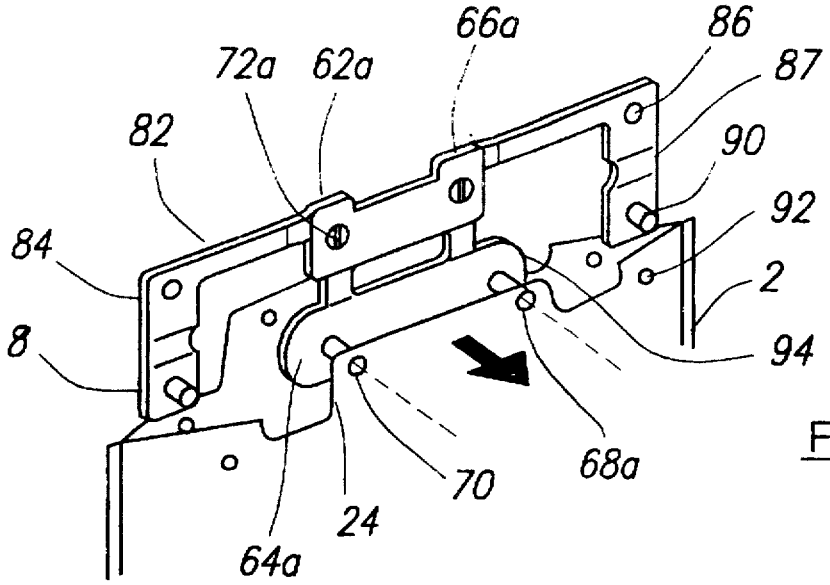
FIG. 16A
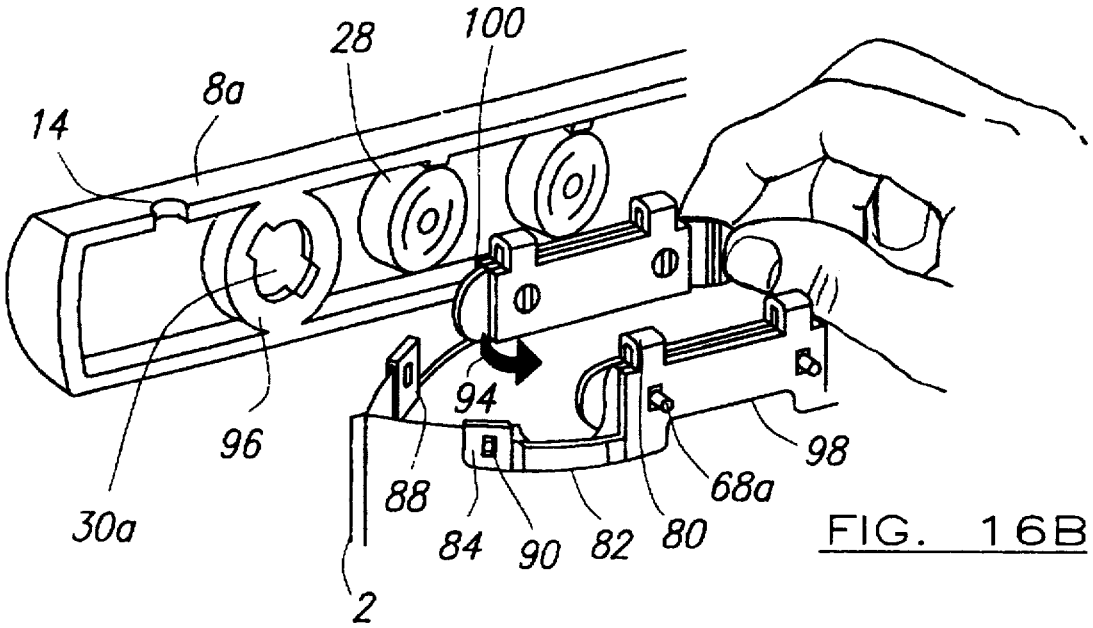
FIG. 16B
FIG. 17
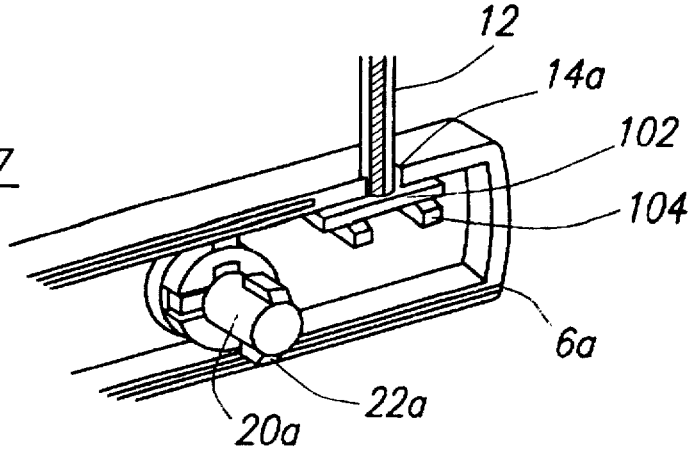

SEALABLE BAG

TECHNICAL FIELD

Background Of The Invention

This invention relates to a sealable bag and in articular, but not exclusively, to a waterproof bag.

One use of sealable of the type to which the invention relates is by yachtsmen for carrying water-sensitive materials or equipment. One known bag for this purpose comprises a pouch which is closed by pressing the portions of the bag around the open end together and then folding them over. The pouch is provided with two pairs of holes each passing through both sheets of the pouch, one pair being positioned further from the opening than the other, such that on folding they may be aligned. A pair of plastic strips are then clamped together on either side of the folded end by passing bolts protruding from one of the strips through the bag holes and apertures in the other strip and then securing the ends of the bolts with nuts. The strips are contoured each having a central section out of the plane of the remainder which causes clamping of the folded edge of the bag on either side of the central section when the strips are connected.

This known sealable bag suffers from a number of disadvantages. The main drawback is that the closure is neither quick nor simple to use. The operation of assembling the different parts of the closure and bag, and tightening the nuts is awkward and requires both hands and may take 30 seconds or longer. Additionally when disassembled the two strips are detached from the bag and may get lost, particularly if the bag is opened by a person engaged in an activity such as sailing or canoeing.

A further disadvantage is that the nuts may be inadequately tightened which means that proper sealing may not be effected. Furthermore, because of the common usage of such bags in a marine environment the nuts and bolts must be made from marine grade steel which is resistant to rusting, which adds to the expense of production of the bag. The folded top requires additional material which adds to the cost of the bag.

It is accordingly amongst the objects of the invention to provide a sealable bag with a simple, practical and inexpensive closure which is easy to use as well as efficiently preventing entry of water into the interior of the bag.

SUMMARY OF THE INVENTION

In accordance with the invention, a bag with an access opening defined by a pair of edges has a closure comprising a first bar secured to at least a part of one edge and a second bar releasably connectable to the first with the edges clamped therebetween to close the opening, whether the resealable connection is formed by at least one bayonet connector.

In a particularly preferred embodiment the releasable connection is formed by one or more connection members which connect a region of each bar directly together and at a distance from the clamped edges. Furthermore, the or each connection member may include means for tightening the connection to increase the clamping pressure on the bag edges.

The securement of one of the bars to the bag edge facilitates opening and closing of the bag and further aids proper positioning of the bag edges to ensure good clamping and consequently good sealing. By connecting the bars directly to each other and at a distance from the clamped edges sealing is further improved and the need to provide holes in the main part of the bag is avoided. The capacity to tighten the connection provided in the preferred embodiment improves sealing and aids assurance of correct sealing when coupled with the features described below.

The connection members include at least one bayonet connector. Cam means may be provided for traversal by the bayonet pin(s) during rotation thereof, the cam means comprising opposite slopes angled such as to tighten the connection. A bayonet connector is much easier to use than a nut and bolt connector, particularly when the user is simultaneously involved in an activity such as sailing or canoeing. A bayonet connector will provide a sure and firm connection and, when coupled with the cam means, will enable a relatively high clamping pressure to be applied.

Detent means may be positioned to cooperate with the bayonet pin(s), or the lever(s) by which it is turned, when the bayonet pin(s) is in a preferred position to provide an audible indication of achievement of that position and/or to releasably lock the pin in that position. The first alternative obviates the problem with known nut and bolt connectors, namely that these may be insufficiently tightened, as the user will receive a perceptible indication that tightening has been correctly achieved. The second ensures that the clamping pressure is consistently applied until the bag is opened.

The bayonet pin(s) may be attached to one bar and the bayonet hole(s) provided in the other with each bayonet connector including a handle for facilitating rotation of the pin.

The second bar may also be secured to at least part of the other edge, with the result that opening the bag will not produce any loose parts. The connection of the bar to the bag edge(s) may be releasable and be achieved, for example, by the use of popper-type connections. In certain situations this may facilitate manufacture.

One bar may define a recess and the other a complementary groove in which the recess is received when the bars are connected, the recess and groove being positioned such that the bag edges will be clamped therebetween. The clamping pressure is therefore applied along a single line which gives effective sealing.

The bag may include a carrying strap secured to one of the bars. This avoids the necessity of attaching the strap directly to the bag. The strap may be secured to both bars with the result that even if the bag is removed from the bars, both bars are still attached to the strap thereby greatly reducing the possibility of losing one or both bars. Moreover with this embodiment, even if both bars are not attached to the bag, on opening a user till has both hands free to remove an item from or insert it into the bag when the bag is open.

BRIEF DESCRIPTION OF THE DRAWINGS

The invention will now be further described by way of example with reference to the accompanying drawings in which:

FIG. 10 is a plan view, partly sectional, of a second embodiment of the closure of the bag of FIG. 1;

FIG. 11 is an end view of the closure of FIG. 10;

FIG. 12 is a rear view of one of the bars of the closure of FIG. 10;

FIG. 13 is a perspective rear view, partly sectional, of a pin connector and the other bar of the closure of FIG. 10;

FIGS. 16 A and B are schematic views illustrating an alternative method or attachment of a bar to a pouch to form a bag of FIG. 1, and, FIG. 17 is a schematic view illustrating a method for attaching a cord to a bag of FIG. 1.

DETAILED DESCRIPTION OF THE PREFERRED EMBODIMENT

Figure 1:
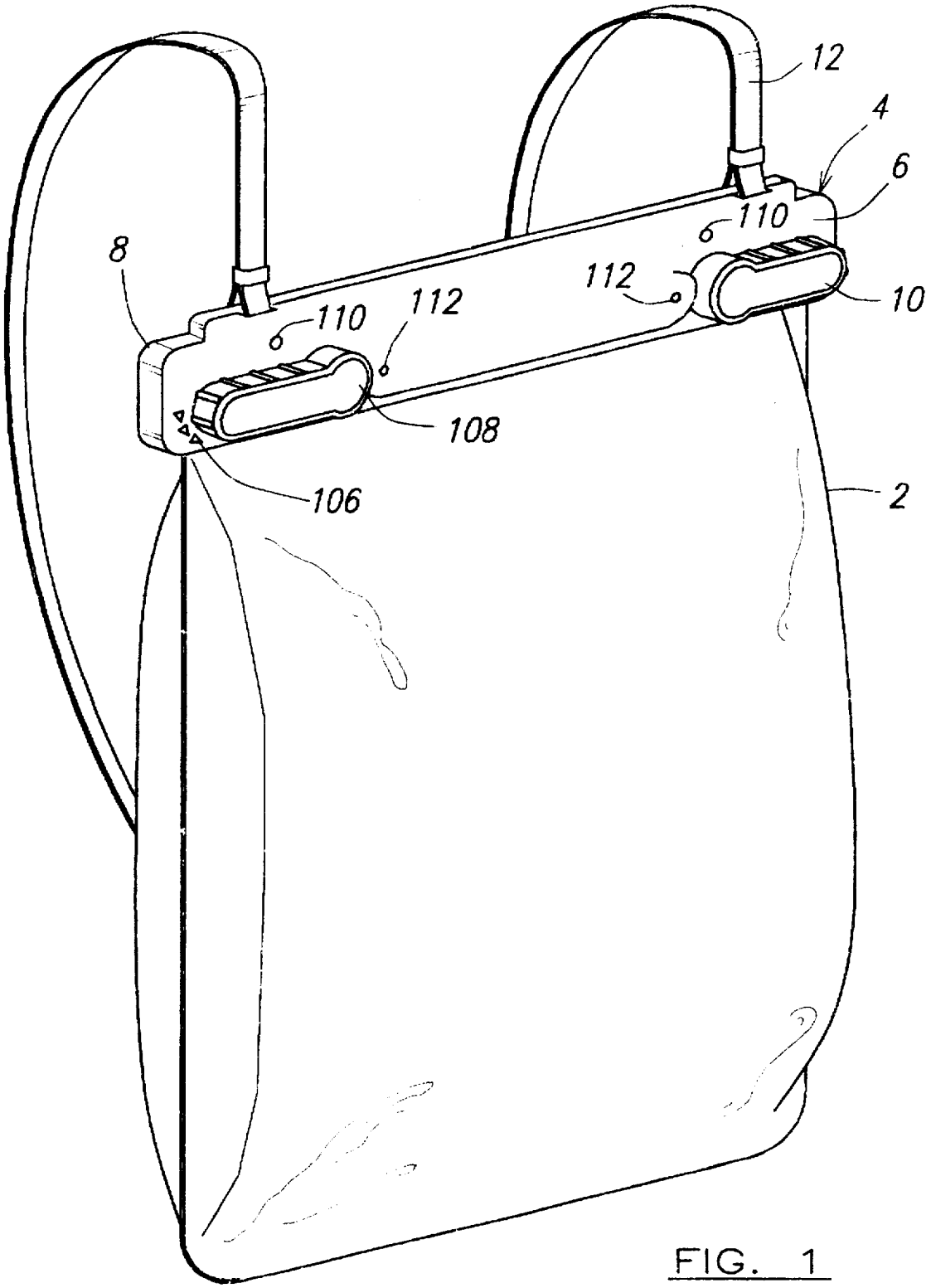
FIG. 1 is a prospective view of a bag in accordance with the invention.

In FIG. 1 a bag 2 is shown with its access opening sealed by a closure 4. The closure comprises two bars 6, 8 which are held together by a pair of connectors operated by levers 10. The access opening of the bag 2 is clamped between the bars 6, 8 to close that opening and to seal it in a watertight fashion.

Figure 2:
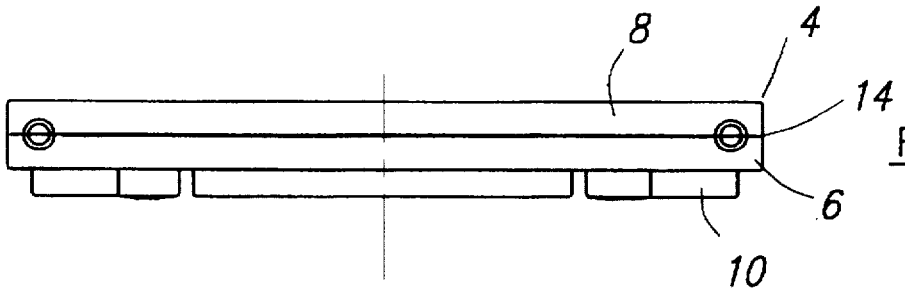
FIG. 2 is a plan view of a first embodiment of the closure of the bag of FIG. 1.

A cord 12 for carrying the bag 2 is attached to the closure 4. As can be seen in FIG. 2, the bars 6, 8 are shaped to provide a hole 14 at both ends of the closure 4 for the cord 12 with one of the bars 8 having connecting apertures therethrough. Alternatively, the bars 6, 8 may be provided with a cord securing mechanism 16, see FIG. 5, at opposite ends as discussed further below. In a further alternative one or both ends of the cord 12 may be attached directly to the bag 2.

Figure 3:
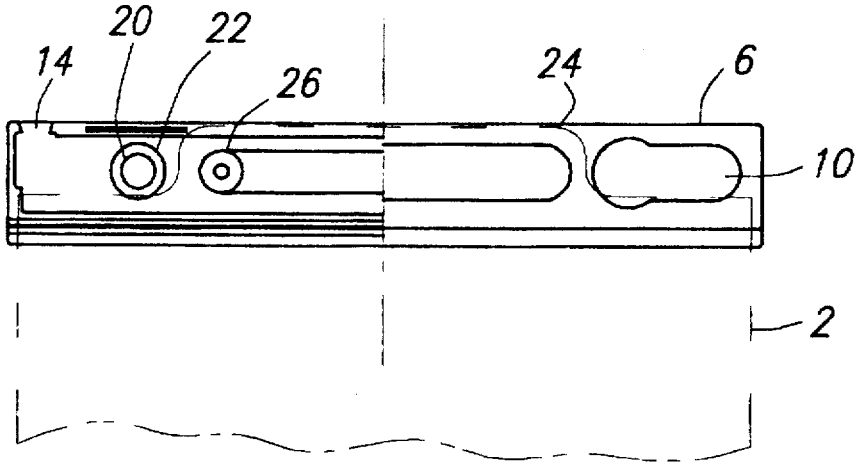
FIG. 3 is a half rear/half front view of one of the bars of the closure of FIG. 2.
Figure 4:
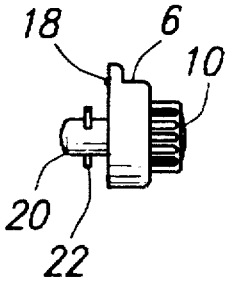
FIG. 4 is an end view of the bar of FIG. 3.

A front view of the bar 6 is shown on the right of FIG. 3 and a rear view thereof on the left. It should be noted herein that "front" and "rear" refer to the respective orientations of the bars 6, 8, to the bag 2 when they are clamped together as shown in FIG. 1. Thus "front" indicates the outer face of each bar 6, 8 when so clamped. A ridge 18 is provided on the rear side of the bar 6 as can be seen in the side view of FIG. 4. As FIG. 4 shows each lever 10 is attached to a shaft 20 which carries a cross pin 22 at its other end. The shaft 20 and pin 22 form one half of a bayonet connector.

As further illustrated in FIG. 3, the upper edges of the bag 2 (shown in dotted outline) may include integral extensions 24, the length of which is slightly less than the distance between the pins 22. The extensions 24 may include female popper members 26 which mate with male popper members 28 on the bars 6, 8 (see FIG. 5), the poppers 26, 28 providing a connection between the bars 6, 8 and the bag 2.

Figure 5:
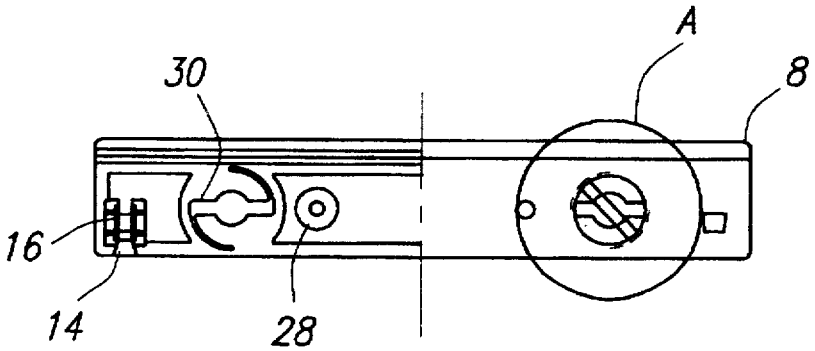
FIG. 5 is a half front/half rear view of the other bar of the closure of FIG. 2.
Figure 6:
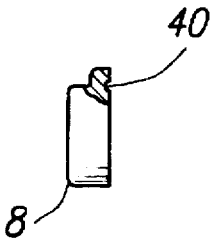
FIG. 6 is a partially sectional end view of the bar of FIG. 5.

The other half of the bayonet connector is provided in bar 8, a front view of which is shown on the right of FIG. 5 with the rear view on the left of that Figure. The bar 8 includes a pair of slots 30 each dimensioned and shaped to receive a shaft 20 and pin 22 with the latter aligned with the axis of the bar 8. Subsequent rotation of the shaft 20 by turning of the lever 10 will bring the pin 22 out of alignment with the slot 30 and lock the bars 6, 8 together.

Figure 7:
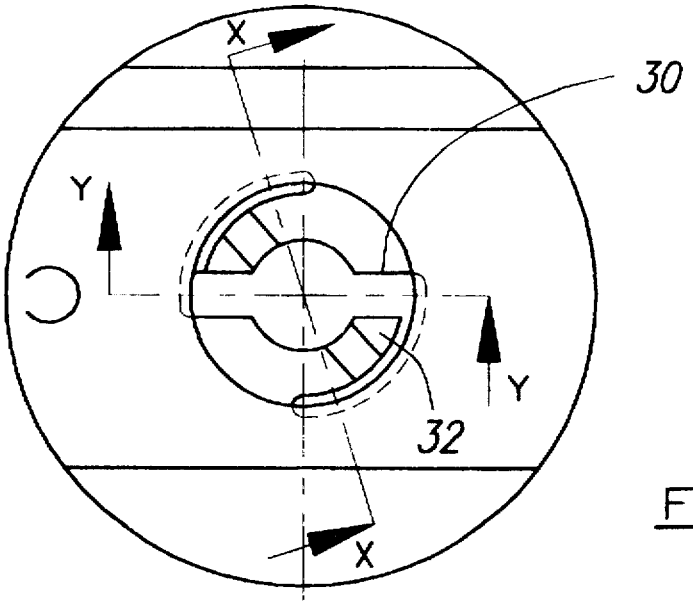
FIG. 7 is an enlarged view of the area A of FIG. 5.
Figure 8:
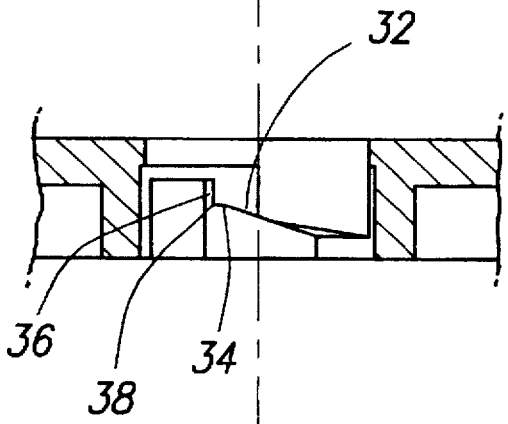
FIG. 8 is a sectional view along line Y—Y of FIG. 7.
Figure 9:
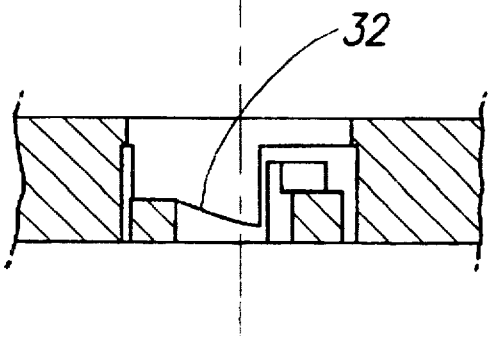
FIG. 9 is a sectional view along the line X—X of FIG. 7.
Figure 14:
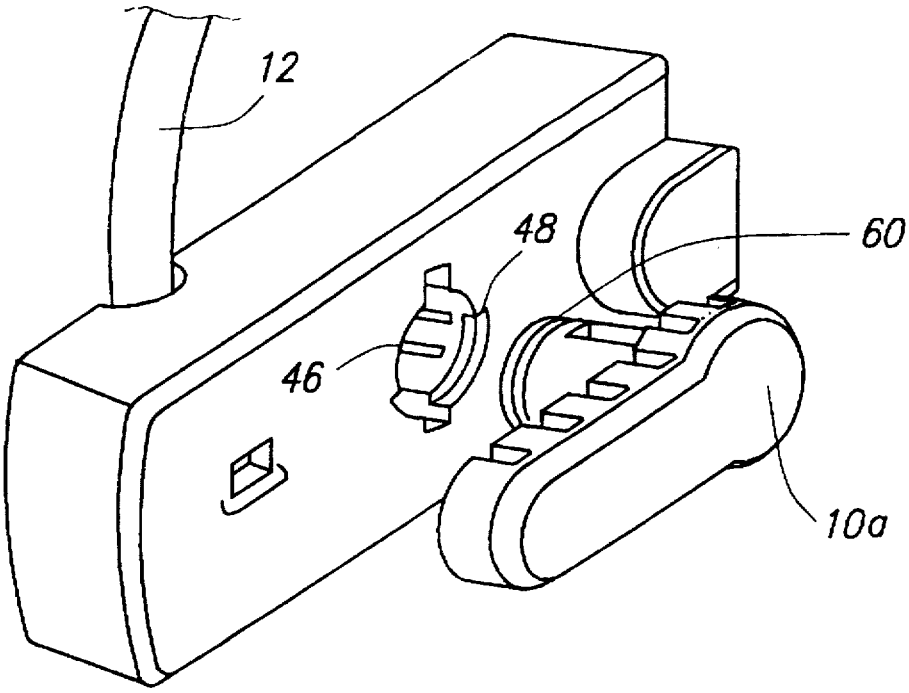
FIG. 14 is a front perspective view of the pin connector and bar of FIG. 13.

On such rotation the pin 22 engages a pair of cams 32 formed on the front side of bar 8. This is illustrated in greater detail in FIGS. 7 to 9. As shown therein, rotation of a shaft 20 (in the anti-clockwise direction in the sense of FIG. 7) engages each arm of the pin 22 with cam 32 which takes the form of a ramp. As the arms of the pin 22 move up the ramp 32 the bars 6, 8 are drawn closer together. On continued rotation of the shaft 20 the arms will pass the ramp 32 and move into a flat region 34. A stop 36 defines the extent of the flat region 34 and thus the maximum rotation of the shaft 20. The flat region 34 may be dished or grooved to define a detent 38. Receipt of the arms of pin 22 in the detent 38 may cause an audible click to give a perceptible indication to a user of the bag that the bars 6, 8 have been properly locked together. Further, the detent may serve to prevent release of the connection without positive turning of the levers 10.

The bar 6 may include upward ribs which latch with corresponding ribs on the underside of the levers 10 to provide a similar locking action in the closed position. Again, the arrangement may be such that there is a sensory indication of locking, audible or tactile.

The bar 8 includes a groove 40 which receives the rib 18 of bar 6. When the bars 6, 8 are connected together the rib 18 and groove 40 grip firmly therebetween the edges of the access opening of bag 2 and apply clamping pressure along a line to produce a watertight seal.

The bars 6, 8 are directly connected together on either side of the extensions 24 but a seal is produced across the full width of the bag 2 therebelow by cooperating rib 18, 14*a* and groove 40.

The bars 6,8 and the levers 10 and shafts 20 may be made from a plastics material. For reasons of strength the pins 22 may be formed from a metal and suitably a marine grade steel is employed. It will be appreciated that the amount of marine grade steel required is significantly less than with known bags of this type so that a correspondingly significant decrease in production costs is achieved.

In an alternative embodiment illustrated in FIGS. 10 to 14, the use of marine grade steel is dispensed with completely. The alternative embodiment has many features in common with that illustrated in FIGS. 2 to 9 and like reference numerals will, therefore, be used for like parts with the suffix a.

As with the first embodiment of the closure 4, the closure 4*a* comprises two bars 6*a*, 8*a* which are held together by a pair of connectors operated by levers 10*a*. Each lever 10*a* is attached to a shaft 20*a* which carries an integral cross pin 22*a* at its other end. The shaft 20*a* and pin 22*a* are relatively much larger in the second embodiment which enables formation of the pin 22*a* from a plastics material. The pin 22*a* may have a length parallel to the shaft 16*a* of 7.5 mm, a width of 3.75 mm and a thickness of about 2.625 mm, ie, dimensions in the ratio 2:1:0.7.

As a consequence of the enlargement of the shafts 20*a* and pins 22*a* of the connectors in the second embodiment, the slots 30*a*, through the bar 8*a* are also correspondingly enlarged. The cam surfaces 32*a* are positioned as close as possible to the rear or inner face of the bar 8*a* so that the pins 22*a* protrude only minimally therefrom. The pins 22*a* are smoothly contoured so that they will not catch or rub a user's body or clothes. The flat region 34 and the detent 38 are dispensed with and an alternative means of locking the pins 22*a* and/or providing an audible indication of sealing is provided which has already been mentioned briefly above in connection with the first embodiment. The levers 10*a* have a rib 42 on their under surfaces which, on rotation of the levers 10*a*, are forced over and locked against sloped detents 44 provided on the front or outer face of the bar 6*a*. The cooperation of the ribs 40 and detents 44 releasably locks the shafts 20*a* and pins 22*a* in the position in which the bag 2 is sealed. Locking can be felt by the user and gives an audible "click" to indicate that sealing has been achieved.

The bars 6*a* include apertures 46 through which each pin connector is inserted pin first, the apertures 46 being similar in form to the slots 20*a* of the bars 8*a*, but including a cut-out 48 on the front or outer face of the bar 6*a*. The levers 10*a* each have a detent 50, which is received in a cut-out 48, the two cooperating to restrict the movement of the levers 10*a* such that the pins 22*a* can only be rotated between the "open" position aligned with the slots 30*a* and the "closed" position at the extremity of the cam surfaces 32*a*. The cut-outs 48 extend around the apertures 46 a distance sufficient to achieve this which distance will depend on the relative positions of the slots 30*a* and cam surfaces 32*a*. In the illustrated embodiment, the cut-outs 48 allow an angular rotation of about 145°.

The bar 6*a* also includes on its back or inner face an integrally formed guide sleeve 52 with a crucifix-form cut-out 54. Two pins 56 with flanged heads 58 protrude into the cut-out 54 on diametrically opposite sides of the sleeve 52. The pins 56 are also integrally formed but can move relative to the sleeve 52.

The shafts 20*a* are formed in two sections separated by a reduced diameter portion 60. The front or pin end shaft section has been omitted in FIG. 14 for the purposes of clarity.

On insertion of the shafts 20*a* through the apertures 46 and the sleeves 52, the pins 56 are pressed apart until their heads align with the reduced diameter portions 60. The heads of the pins 56 lock in the reduced diameter portions 60 and thus serve to hold the shafts 20*a* in place in the bar 6*a*.

A suitable plastics material for the second embodiment is ABS, either alone or with glass reinforcement. The ABS may be UV stabilised. The same material may be used in the first embodiment.

At least one of the bars 6, 8, 6*a*, 8*a*, but preferably both, are connected to the bag 2 at the access opening thereof. This connection may be permanent but is preferably releasable. In the latter case, as illustrated with respect to the first embodiment, the connection may be achieved by the provision of poppers, with the female members 26 being provided on the bag 2 and male members 28 on the bars 6, 8.

Figure 15:
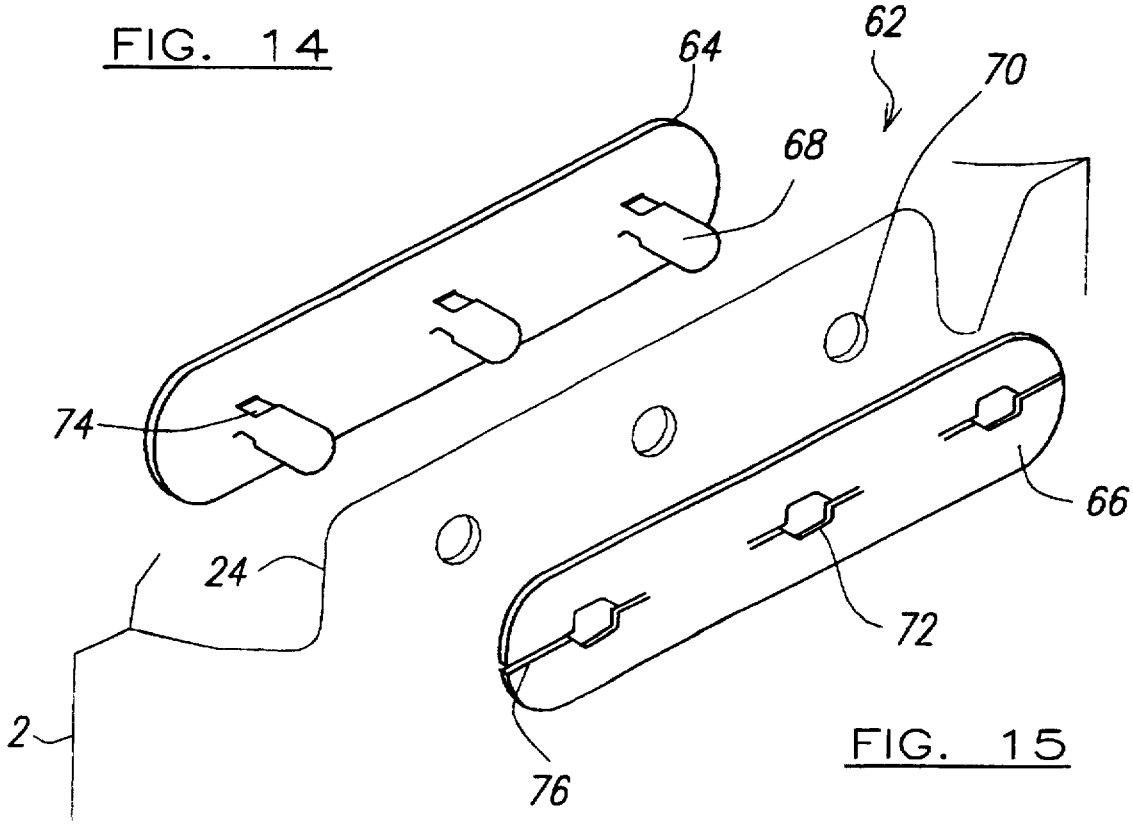
FIG. 15 is a schematic view illustrating a method of attachment of a bar to a pouch to form a bag of FIG. 1.

Alternatively, as shown in FIG. 15 in very schematic fashion with all detail of the bars omitted, two-part attachment strips 62 may be provided. Each strip comprises a male part 64 and a female part 66 connected together on either side of an edge of the access opening of the bag 2. The male strip part 64 is formed with a plurality of sprues 68 which are passed through apertures 70 in the bag extension 24 and received in appropriately shaped holes 72 in the female part 66. The sprues 68 are each formed with a reduced thickness portion 74 dimensioned to be closely received in one of the holes 72. The holes 72 are formed with slots 76 which allows flexure of the female part 66 to accommodate passage of the sprues 68 through the holes 72 and seating of the reduced thickness portions 74 in the holes 72. The protruding portions of the sprues 68 are received in blind holes 78 in the inner faces of the bars 6*a*, 8*a*, the blind holes 78 being dimensioned such that the ends of the sprues 68 form a friction fit therewith.

An alternative form for the sprues 68 is illustrated in FIG. 16, which also shows a preferred form of the attachment strips 62, in which these are one part. The alternative embodiment has features in common with that illustrated in FIG. 15, and like reference numerals will therefore be used for like parts with the suffix a.

As with the two part attachment strip 62, the one part attachment strip 62*a* has sprues 68*a*, which are received in holes 72*a*. The sprues 68*a* are split and are moulded such that the two half sections of each sprue 62*a* are biased apart. The sprues 62*a* taper outwardly towards the free end thereof. The biasing and tapering together combine to assist in formation of a frictional fit with the holes 72*a* in the bag extensions 24, so that reduced diameter regions are not required and the holes 72*a* can be simply rounded, as well as with the holes 78 in the bars 6*a*, 8*a*.

The male and female parts 64*a*, 66*a*, are connected together by flexible hinges 80 which allow the two parts 64*a*, 66*a*, to be positioned face to face with the sprues 68*a* passing through the apertures 70 in the bag extensions 24 and through the holes 72*a*.

As illustrated in FIG. 16, the female part 66*a*, includes integral thin webs 82 extending either side thereof and carrying at their ends female extension members 84 with holes 86 therein connected by hinges 87 to male extension members 88 with sprues 90 extending therefrom. The extension members 84, 88, allow connection of the attachment strip 62*a* to the upper edges of the bag 2 which is provided with apertures 92 for receipt of the sprues 90. It has been found that this prevents pulling of the bags sides from inside the closure 4*a*.

The bag 2 with both strips 62*a* secured thereto is shown in FIG. 16B. As illustrated in that figure, the thin webs 82 provide a flexibility allowing for arching of the strip 62*a* which facilitates removal and insertion of items into the bag 2 by creating a solid quasi-circular aperture. As also illustrated in that figure, the male part 64 has two tabs 94 which can be grasped by user to pull the strips 62*a* off the bars 6*a*, 8*a* without the need for any tools.

Whichever form of sprue 68, 68*a* is employed, either that illustrated in FIG. 15 or that illustrated in FIG. 16A, it has been found that two sprues 68, 68*a* are sufficient to secure the strips 62, 62*a* to the bars 6*a*, 8*a*. Accordingly, if three sprues 68 are provided on each male part 64, to give a good grip to the top of the bag 2, the central sprue 68 may be made of reduced length as illustrated in FIG. 15.

As shown in FIG. 16B, use of the attachment strip 62*a* requires modification of the bars 6*a* and 8*a* by the provision of recesses 96 for seat of the thin webs 82. FIG. 16B also shows that the female part 66*a* includes a cut-out 98. The cut-out 98 accommodates ribs 100, the edge of one of which can just be seen in the FIG. 16B, which protrude from the bar 8*a*. A single lengthwise rib is provided in the bar 6*a*, on the other edge to the ribs 100. These ribs ensure that the bars 6*a* and 8*a*, can only be connected together the right way round.

The arrangement illustrated in FIG. 3 with popper connections 26, 28, between the bag 2 and the bars 6, 8 may be provided in a kit form with the poppers separate. The male popper members are inserted through holes in the extensions 24 and snapped on to matching female members 26, which should be non-returnable, ie, non-removable. The male popper members 26 will then pop into corresponding female apertures on the bars 6, 8. This kit form bag allows a reduction in manufacturing costs since welding of a male popper member is time-consuming.

It will be appreciated that the arrangement illustrated in FIGS. 15 and 16, with the attachment strips 62, 62*a*, is also very suitable for supplying in kit form, particularly the latter, with the customer assembling the attachment strips 62, 62*a* onto the bag himself. Alternatively, of course, the bars may be preassembled on the bags which is a cheap and relatively simple operation requiring no plastics welding.

The strap 12 may also be self assembled to the bag 2 if a cord securing mechanism 16 is provided of the form illustrated in FIG. 17. The strap 12 has T-bar 102 at its end. The T-bar 102 is inserted in an aperture 14 generally in alignment with the strap 12. On manipulation of the strap 12 to bring the T-bar 102 out of alignment, the latter latches under the rim of the bar 6*a*, 8*a*. Preferably, the T-bar 102 is wedged between the rim and support pins 104 positioned there below to retain the T-bar 102 firmly in position. The T-bar 102 may as illustrated be generally square or it may be circular with ribs to maximise the contacting surfaces.

It is preferred that a connection mechanism 16 be provided on each bar 6, 8, 6*a*, 8*a*, with the result that when the closure 44*a* is opened the strap 12 connects the bars 6, 8, 6*a*, 8*a*, and thereby prevents their lose, even if either or both detach from the bag 2. Further, strap 12, if connected to both bars, supports the two sides of the bag 2 and facilitates insertion and removal of items.

It will be appreciated that the strap 12 need not be provided and that the bag 2 could alternatively be connectible to a belt or lanyard. In such a case the bars 6, 8, 6*a*, 8*a* are preferably rounded as they will come into contact with the body and this will increase user comfort.

The attachment of at least one of the bars 6, 8, 6*a*, 8*a* to the bag 2 facilitates use, assists with correct location of the edges of the bag between the bars 6, 8, 6*a*, 8*a* and rigidifies the bag 2 in the region of the access opening. Further, on release of the bayonet connectors the assembly overall simply divides into two parts. In the preferred embodiment, where both bars 6, 8, 6*a*, 8*a* are attached to the bag 2, there is no separation of the assembly whatsoever on opening the bag. The strips 62, 62*a* provide for a secure connection of the bars with a weight of up to 1 kg. inside the bag but can still be removed by hand. The strips and bars can therefore be removed for cleaning or the like or replaced at any time without tools.

The bag 2 can be readily opened and closed in each case simply by rotating each lever 10 through less than 90°. The operation is facilitated by visual signals as illustrated in FIG. 1. These may include triangles 106 indicating the direction the levers 10,10*a* move to travel from open to closed. A rib 108 may be provided on top of the levers 10, 10*a* which marries up with either a circle 110, indicating open, or a dot 112, indicating closed, when the lever 10,10*a* is in the respective position.

The use of bayonet connectors is advantageous in that, bayonet connectors facilitate opening and closing are simpler and quicker than nuts and bolts and facilitate opening and closing which can take only 2–3 seconds. When, as in the preferred embodiment, cams are provided for traversal by the arms of the pins of the bayonet connectors, the closure is afforded a tightening facility, tightening being automatically achieved by a proper use of the bayonet connectors. The provision of detents ensures that proper tightening is achieved giving an audible and/or tactile indication of this to a user and/or preventing inadvertent release. Furthermore the amount of marine grade steel which is required is reduced. With the first embodiment, only the pins 18 need be formed from steel whilst in the second, no steel is required at all.

It will also be appreciated that the extensions 24 may be dispensed with by increasing the spacing between slots 30, 30*a* and groove 40, 40*a* of bar 8, 8*a* and shafts 20, 20*a* and rib 18, 18*a* of bar 6, 6*a* to define a location for attachment of the edges of the bag 2. However, the illustrated embodiment is preferred as the force produced by the bayonet connections is applied as close as possible to the ridge/groove combination which maximises the clamping pressure produced by that combination.

Tests have shown that the clip formed by the bars 6, 8, 6*a*, 8*a* is a very effective sealant being waterproof to a depth of at least 20 meters or 2 atmospheres of pressure even after opening and closing ten thousand times. The bag is, therefore, useful for applications such as snorkelling where a snorkeller wishes to take a camera or some electronic instrument for scientific purposes. Even if not to be used at such a depth or pressure, the clip ensures user peace of mind for owners of expensive equipment such as mobile phones, cameras, etc on marine devices such as boats or canoes. Further, the effectiveness of the seal is such that sealed bags have some buoyancy so that the bags will float if dropped in the water enabling retrieval.

It will be appreciated that the bag is suitable for many other uses and in particular has industrial and medical applications where a sealed protected environment is required.

We claim:

1. A bag with an access opening defined by a pair of edges and a closure comprising a first bar releasably secured to at least one part of a first of said edges, a second bar releasably secured to at least one part of a second of said edges, releasable connection means for connecting said first and second bars together with said first and second edges clamped directly together therebetween to close the opening, said releasable connection means including at least one bayonet connector comprising a rotatable bayonet pin attached to one of said bars and a bayonet hole in the other of said bars, and, means for tightening the connection between said first and second bars to increase the clamping pressure on said first and second edges and thereby to form a waterproof seal across the access opening.

2. A bag as claimed in claim 1 wherein the at least one bayonet connector connects regions of the bars directly to each other and at a distance from the clamped edges.

3. A bag as claimed in claim 1 including cam means for traversal by the bayonet pin of the at least one, bayonet connector during rotation thereof, the cam means comprising opposite slopes angled such as to tighten the connection.

4. A bag as claimed in claim 1 wherein a lever is provided for turning the bayonet pin of the at least one bayonet connector and the closure includes detent means positioned to cooperate with the bayonet pin or the lever when the bayonet pin is in a preferred position to provide an audible indication of achievement of that position to releasably lock the pin in that position.

5. A bag as claimed in claim 1 wherein one bar include s a groove and the other defines a complementary ridge which is received in the groove when the bars are connected together with the bag edges clamped therebetween.

6. A bag as claimed in claim 1 including a carrying strap secured to one of the bars.

7. A bag as claimed in claim 1 wherein a lever is provided for turning the bayonet pin of the at least one bayonet connector and the closure includes detent means positioned to cooperate with the bayonet pin or the lever when the bayonet pin is in a preferred position to releasably lock the pin in that position.

* * * * *

UNITED STATES PATENT AND TRADEMARK OFFICE

CERTIFICATE OF CORRECTION

PATENT NO. : 5,797,683
DATED : August 25, 1998
INVENTOR(S) : Laurence A. Gunzi; and
Massimo G.F. Malavasi It is certified that errors appear in the above-identified patent and that said Letters Patent is hereby corrected as shown below:

Column 1; line 7; delete [articular] and insert therefor –particular–; and

Column 1; line 9; after sealable insert –bags–.

Signed and Sealed this

Twenty-first Day of November, 2000

*Attest:*

Q. TODD DICKINSON

*Attesting Officer*

*Director of Patents and Trademarks*